US006046537A

United States Patent [19]

Sukeno

[11] Patent Number: 6,046,537

[45] Date of Patent: Apr. 4, 2000

[54] COLOR PICTURE TUBE HAVING REDUCED PICTURE DISTORTION

[75] Inventor: Masahiko Sukeno, Ashiya, Japan

[73] Assignee: Matsushita Electronics Corporation, Osaka, Japan

[21] Appl. No.: 09/118,589

[22] Filed: Jul. 17, 1998

[30] Foreign Application Priority Data

Aug. 5, 1997 [JP] Japan ..... 9-210952

[51] Int. Cl.[7] ..... H01J 29/50

[52] U.S. Cl. ..... 313/414; 313/412

[58] Field of Search ..... 313/412, 414, 313/460, 458

[56] References Cited

U.S. PATENT DOCUMENTS

| | | | |
|---|---|---|---|
| 4,429,252 | 1/1984 | Vieland et al. | 313/414 |
| 5,034,652 | 7/1991 | Shimona et al. | 313/412 |
| 5,142,189 | 8/1992 | Sugahara et al. | 313/414 |
| 5,466,983 | 11/1995 | Shitai et al. | 313/414 |

FOREIGN PATENT DOCUMENTS

| | | | |
|---|---|---|---|
| 0 762 464 A2 | 3/1997 | European Pat. Off. | H01J 29/50 |

*Primary Examiner*—Nimeshkumar D. Patel
*Assistant Examiner*—Joseph Williams
*Attorney, Agent, or Firm*—Sheridan Ross P.C.

[57] ABSTRACT

In order to increase the horizontal diameter of the lens and reduce the horizontal diameter of the peripheral spot for improving the resolution along the periphery of the phosphor screen of an in-line color picture tube, the focusing grids are so formed that the focusing force of the lens action on low voltage side is weaker in horizontal direction than in vertical direction and the diverging force of the lens action on high voltage side is weaker in horizontal direction than in vertical direction. As a result, the horizontal lens diameter increases, and the horizontal diameter of the peripheral spot is reduced even in the case where the laterally elongated distortion becomes conspicuous due to the increasing trend toward the flattening or the increased deflection angle of the panel.

8 Claims, 10 Drawing Sheets

COLOR PICTURE TUBE HAVING REDUCED PICTURE DISTORTION

BACKGROUND OF THE INVENTION

The present invention relates to a color picture tube in which a high resolution is sought for over the entire area of the phosphor screen.

The resolution of a color picture tube can be improved by reducing the spot diameter of an electron beam. It is known that this can be achieved by increasing the diameter of the main lens formed by focusing grids and a final accelerating grid.

The conventional in-line electron gun, as disclosed in U.S. Pat. No. 5,142,189, employs a method of increasing the diameter of the main lens by superposing the lens fields for focusing the three beams of R, G, B.

In the above-mentioned conventional method, however, the horizontal diameter of the main lens becomes smaller than the vertical diameter thereof. In the case where the horizontally elongated distortion becomes conspicuous with the sectional shape of the peripheral spot elongated in horizontal direction due to the trend toward the flattening of the phosphor screen panel and the increased deflection angle, the above-mentioned conventional method is disadvantageous for reducing the horizontally elongated distortion by reducing the horizontal diameter of a spot on the periphery of the color picture tube (hereinafter referred to as the peripheral spot).

It has been known that the diameter of the main lens can be increased by increasing the distances from the positions of the field-correcting electrodes arranged on the focusing grids and the final accelerating grid to the respective opening ends, and thus increasing the degree of superposition of the lens fields. This results in excessively small center distance between the center lens and the side lenses, however, making it necessary to increase the distance between the shadow mask and the phosphor. The color picture tube thus is easily affected by the geomagnetism. As a result, a color drift is liable to occur as the electron beam fails to impinge correctly on the phosphor. A solution to this problem has long been sought for.

In order to solve this problem, the object of the present invention is to provide a color picture tube in which the horizontal lens diameter is increased without much reducing the center distance between the center lens and the side lenses as compared with the prior art.

BRIEF SUMMARY OF THE INVENTION

An in-line color picture tube of the present invention comprises a plurality of focusing grids each having an elliptical opening with a horizontal long axis, and it is characterized in that the focusing grids are formed in such a manner that the horizontal focusing force is weaker than the vertical focusing force in the lens action of the low-voltage focusing grid to be applied with a low voltage and the horizontal diverging force is weaker than the vertical diverging force in the lens action of the high-voltage focusing grid to be applied with a high voltage.

By forming the focusing grids in the above-mentioned manner, the horizontal lens diameter can be increased without much reducing the center distance between the center lens and the side lenses. As a result, the horizontally elongated distortion of the peripheral spot, even if it has become conspicuous due to the flattening of the phosphor screen panel or the increased deflection angle, can be reduced by reducing the horizontal diameter of the peripheral spot.

According to the present invention, the quadrupole component of the electric field of the main lenses is rendered different from that of the prior art. The converging grids are formed in such a manner that the horizontal converging force is weaker than the vertical converging force in the lens action on low voltage side and the horizontal diverging force is weaker than the vertical diverging force in the lens action on high voltage side. In this way, the horizontal lens diameter can be increased without extremely increasing the center distance between the center lens and the side lenses. Consequently, even in the case where the horizontally elongated distortion becomes conspicuous by flattening the panel and increasing a deflection angle of the color picture tube, the horizontal diameter of the peripheral spot can be reduced for an improved peripheral resolution of the phosphor screen without causing any color drift.

DETAILED DESCRIPTION OF THE INVENTION

Preferred embodiments of the present invention will be described in detail with reference to FIGS. 1 to 11 hereafter.

Figure 1:
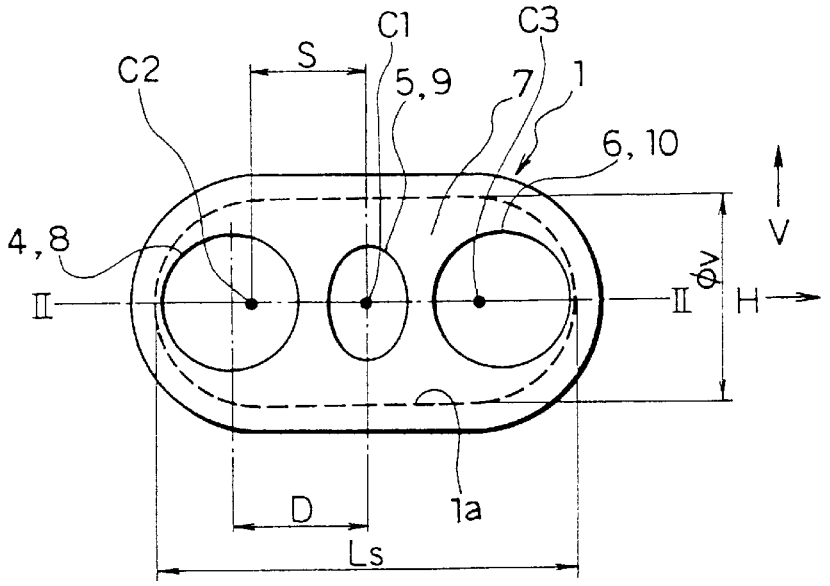
FIG. 1 is a front view of a focusing grid of a color picture tube according to an embodiment of the present invention.
Figure 2:
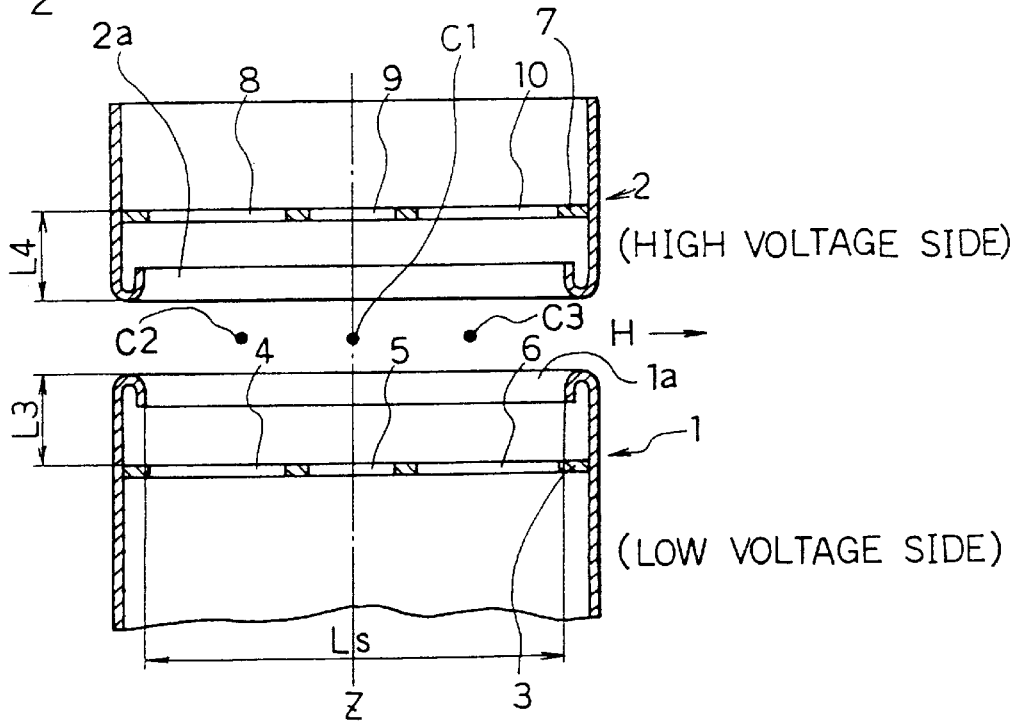
FIG. 2 is a sectional view taken in line II—II in FIG. 1.

FIG. 1 is a front view of a focusing grid 1, and FIG. 2 is a sectional view taken in line II—II in FIG. 1. In FIG. 2, the low-voltage focusing grid 1 to which a low voltage is applied and a high-voltage final accelerating grid 2 to which a high voltage is applied are arranged in opposed relation to each other and have elliptical openings 1*a*, 2*a*, respectively, having a long axis along the horizontal direction H at the opposed edges thereof. The focusing grid 1 has a field-correcting grid 3 inside the opening 1*a*. The field-correcting grid 3 has three apertures 4, 5, 6 formed in line through which electron beams pass.

The final accelerating grid 2 includes a field-correcting grid 7 inside the opening 2*a*. The field-correcting grid 7 has three apertures 8, 9, 10 arranged in line through which the electron beams are passed. The respective configurations of the focusing grid 1 and the final accelerating grid 2 according to the embodiment of the present invention shown in FIGS. 1 and 2 are similar to those of the focusing grid 1 and the final accelerating grid 2 shown in FIGS. 1 and 2 of the prior art disclosed in U.S. Pat. No. 5,142,189 described above. According to the present invention, however, the dimensions of each part of the focusing grid 1 and the final accelerating grid 2 are different from those of the prior art as will be described in detail below.

In the focusing grid 1 and the final accelerating grid 2 of a color picture tube having the neck diameter of ϕ24.3 mm according to an embodiment of the present invention shown in FIGS. 1 and 2, the horizontal diameter Ls of the openings 1*a*, 2*a* is 14.0 mm and the vertical diameter ϕv thereof is 6.7 mm. The ratio ϕv/Ls of the vertical diameter ϕv to the horizontal diameter Ls is about 0.48. In the prior art, a color picture tube having a neck diameter of ϕ32.5 mm is shown, in which Ls is 21.0 mm and ϕv is 10.5 mm. For comparison with the present invention, assuming that the prior art is applied to a color picture tube having a neck diameter of ϕ24.3 mm, it follows that the horizontal diameter Ls is 14.0 mm, the vertical diameter ϕv is 7.5 mm and the ratio ϕv/Ls is about 0.54.

In the color picture tube configured as described above, the electric fields derived from the three apertures 4, 5 and 6 of the field-correcting grid 3 are superposed on those derived from the three apertures 8, 9 and 10 of the field-correcting grid 7. Further, the inventor has confirmed from the simulation described below that these electric fields are combined with the electric fields due to the openings 1*a* and 2*a*, so that three main lenses having a large diameter are formed between the focusing grid 1 and the final accelerating grid 2. Assuming that the focusing grid 1 is impressed with 6.5 kV (kilovolt) and the final accelerating grid 2 with 25 kV, and that the distance from the center C1 of the center main lens having a center axis Z (hereinafter is referred to as Z axis) to the screen (not shown) is 265 mm, the characteristics of the main lenses were calculated by simulation as follows. In this simulation, the potential V(x,y,z) in the neighborhood of the Z axis of the main lenses can be decomposed into a potential Vo(z) on Z axis, a rotational symmetry element R(z) and a quadrupole element Q(z), and can be expressed by equation (1).

$$V(x,y,z)=Vo(z)+R(z)(x^2+y^2)+Q(z)(x^2-y^2) \quad (1)$$

Equation (1) is differentiated by x, y. Thus, the horizontal field strength Ex and the vertical field strength Ey can be determined by equations (2) and (3), respectively.

$$Ex = \partial V(x, y, z)/\partial x = 2x(R(z) + Q(z)) \quad (2)$$

$$Ey = \partial V(x, y, z)/\partial y = 2y(R(z) - Q(z)) \quad (3)$$

In the above-mentioned equations, R is a rotational symmetry component, and Q is a horizontal quadrupole component (a vertical quadrupole component is given as −Q). The quadrupole component is defined as a component of a field distribution in which the horizontal and vertical lens actions are mutually opposite to each other. This field distribution is called a quadrupole electric field. The mutually opposite lens action is as follows: when the horizontal lens action is focusing and the vertical lens action is divergence, for example, such a lens action is called the quadrupole lens action. The field strengths Ex and Ey are proportional to the combination of the rotational symmetry component R and the quadrupole component Q. Specifically, the lens action can be determined by examining the distribution of the rotational symmetry component R and the quadrupole component Q.

Figure 3:
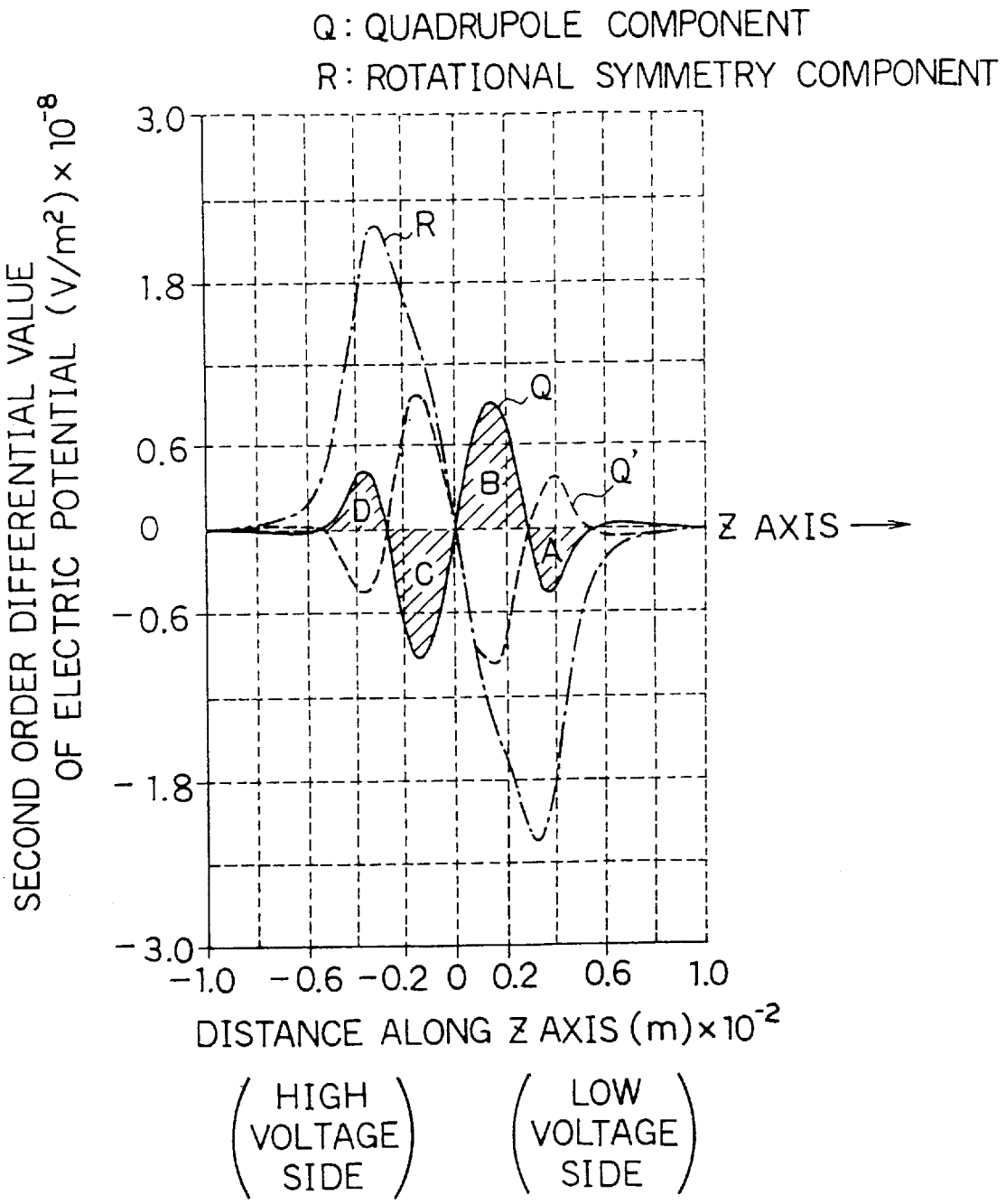
FIG. 3 is a graph showing the change along Z axis of the quadrupole component Q and the rotational symmetry component R formed by the focusing grid according to the invention.
Figure 11:
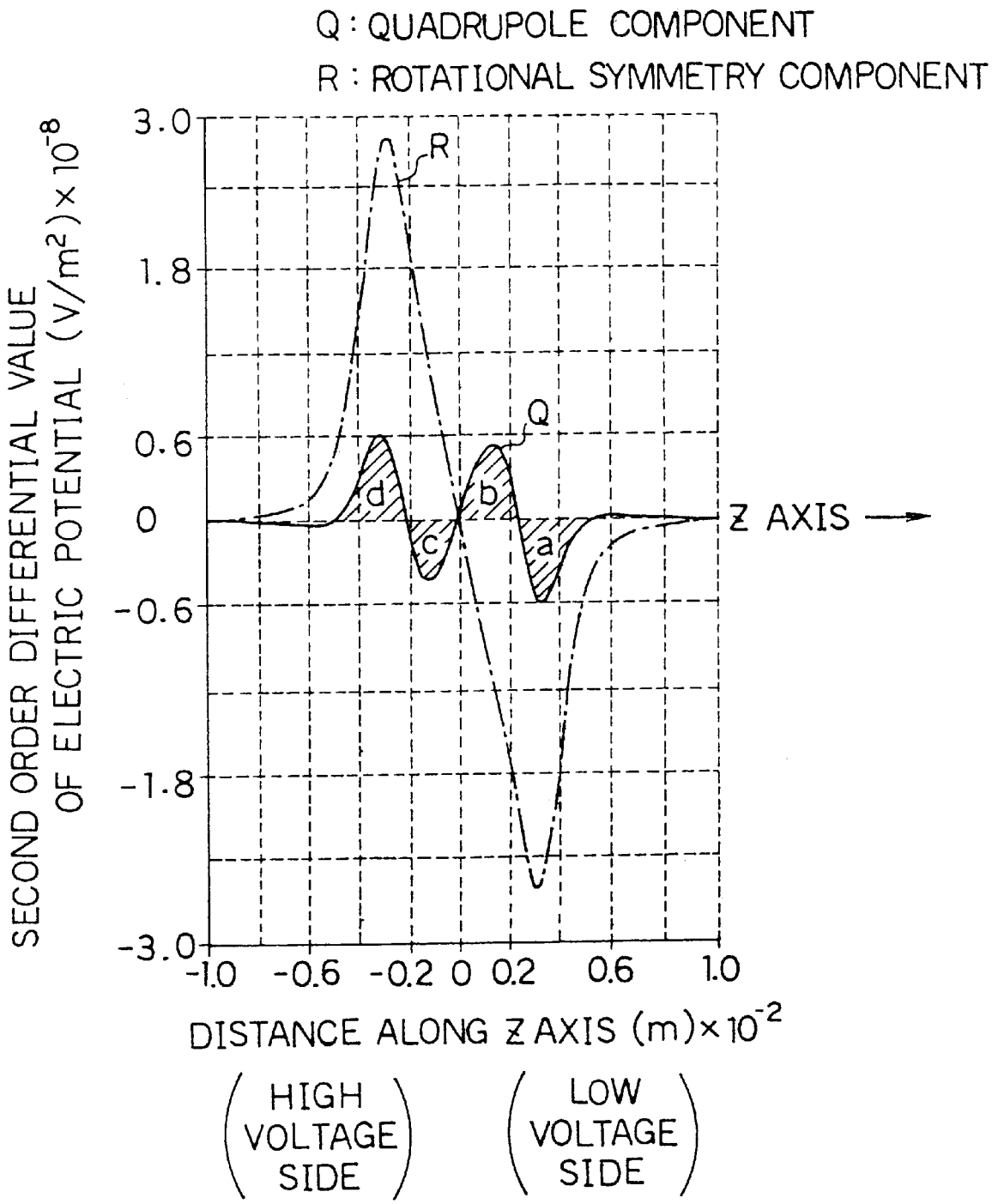
FIG. 11 is a graph showing the change along Z axis of the quadrupole component Q and the rotational symmetry component R formed by the focusing grid according to the prior art.

The result of the above-mentioned simulation is shown in FIG. 3 and FIG. 11. In FIGS. 3 and 11, the ordinate represents the rotational symmetry component R and the quadrupole component Q designated by a second order differential value of electric potential, and the abscissa represents the distance along Z axis. The present invention is shown in the graph of FIG. 3, and the prior art in the graph of FIG. 11. The value 0 on Z axis indicates the center C1 of the center main lens. The negative value represents the distance toward the final accelerating grid 2 (on high voltage side), and the positive value the distance toward the focusing grid 1 (on low voltage side). In these graphs, the quadrupole component Q represents a horizontal one. The vertical quadrupole component is designated by a curve Q' which is symmetric about the Z axis to the horizontal quadrupole component Q. In the graphs of FIGS. 3 and 11, the areas between the curve portions lower than the Z axis and the Z axis are where the focusing force is exerted on the electron beam, while the areas between the curve portions above the Z axis and the Z axis are where the diverging force is exerted on the electron beam. The size of these two types of area represents the magnitude of the lens action exerted on the electron beam.

The rotational symmetry component R has the same lens action in vertical and horizontal directions. The quadrupole component, however, has the opposite lens action in horizontal and vertical directions, one the focusing action and the other the diverging action.

The whole lens action can be considered as a combination of the rotational symmetry component R (hereinafter referred to simply as R) and the quadrupole component Q (hereinafter referred to simply as Q). The lens action in the horizontal direction is different from that in the vertical direction depending on the action of Q. According to the present invention, the horizontal lens diameter can be increased by making a different distribution of Q from that of the prior art.

The present invention, as shown in FIG. 3, is characterized by the difference in Q distribution from the prior art shown in FIG. 11. In the Q curve of the prior art shown in FIG. 11, the areas a and b have substantially the same size on low voltage side. Also, on high voltage side, the area d above Z axis and the area c below Z axis are slightly different from each other, so that the quadrupole lens action of the low-voltage areas a and b and the high-voltage areas c and d are substantially zero. Consequently, the lens action is substantially the same in horizontal and vertical directions.

According to the present invention, in contrast, as shown in FIG. 3, the size of the area B above Z axis (divergence) is larger than that of the area below Z axis (focusing) in the Q curve. The quadrupole lens action in horizontal direction, therefore, is divergence, while the quadrupole lens action in vertical direction, which is opposite to that in horizontal direction, is focusing. Since the lens action due to R on low-voltage side is focusing action, it follows that the combined lens action due to R and Q on low-voltage side is such that the focusing force is weaker in horizontal direction than in vertical direction. On the high-voltage side of the Q curve in FIG. 3, the size of the area C below Z axis (focusing) is larger than that of the area D above Z axis (divergence). In other words, the horizontal quadrupole lens action is focusing, while the vertical quadrupole lens action, which is opposite to the horizontal quadrupole lens action, is divergence. Since the lens action due to R on high-voltage side is divergence, it follows that the combined lens action of R and Q on high-voltage side is such that the divergent force is weaker in horizontal direction than in vertical direction.

Figure 4:
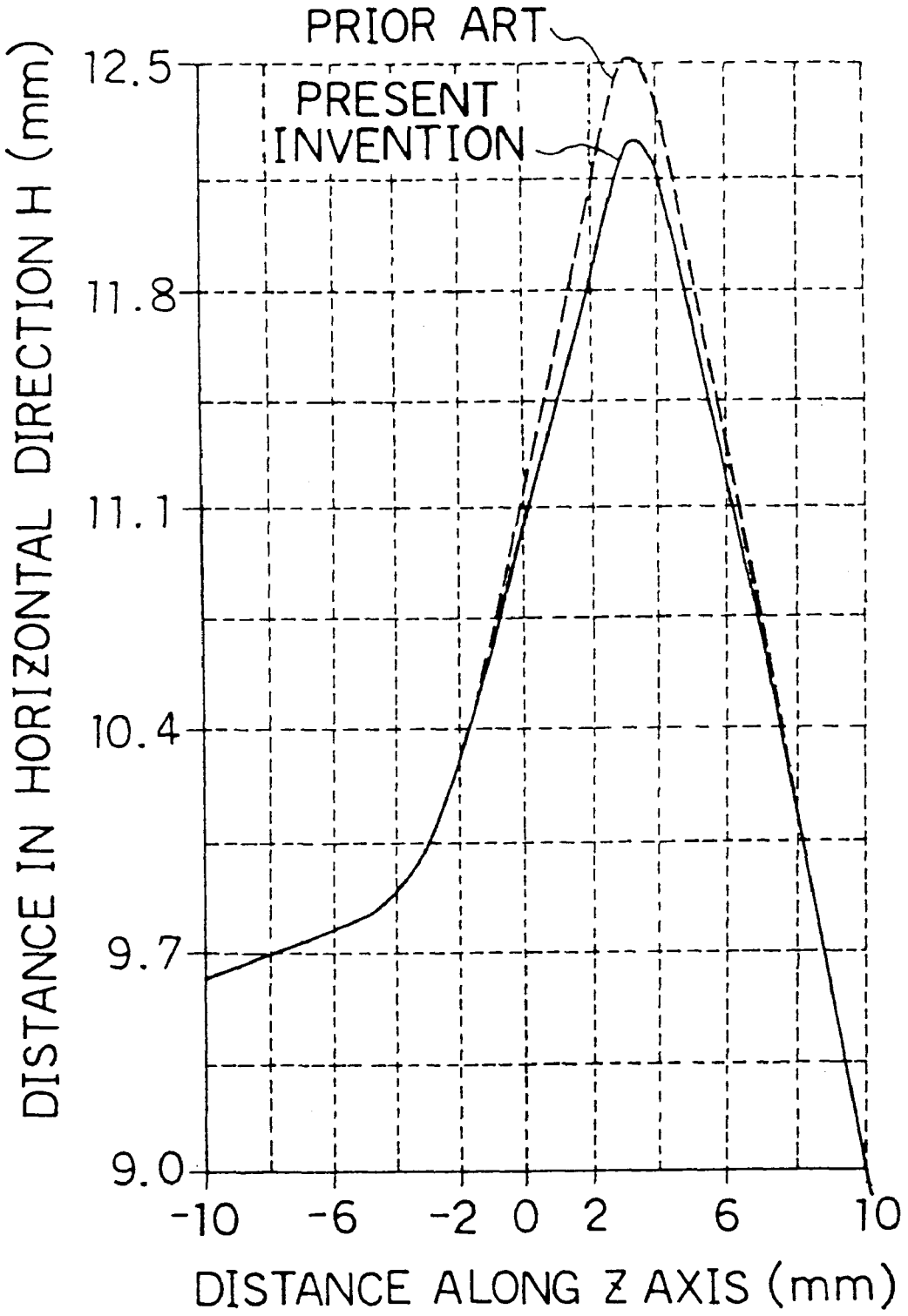
FIG. 4 is a graph showing the relation between the position on Z axis and the horizontal deflection of the electron beam track according to the invention and the prior art.
Figure 5:
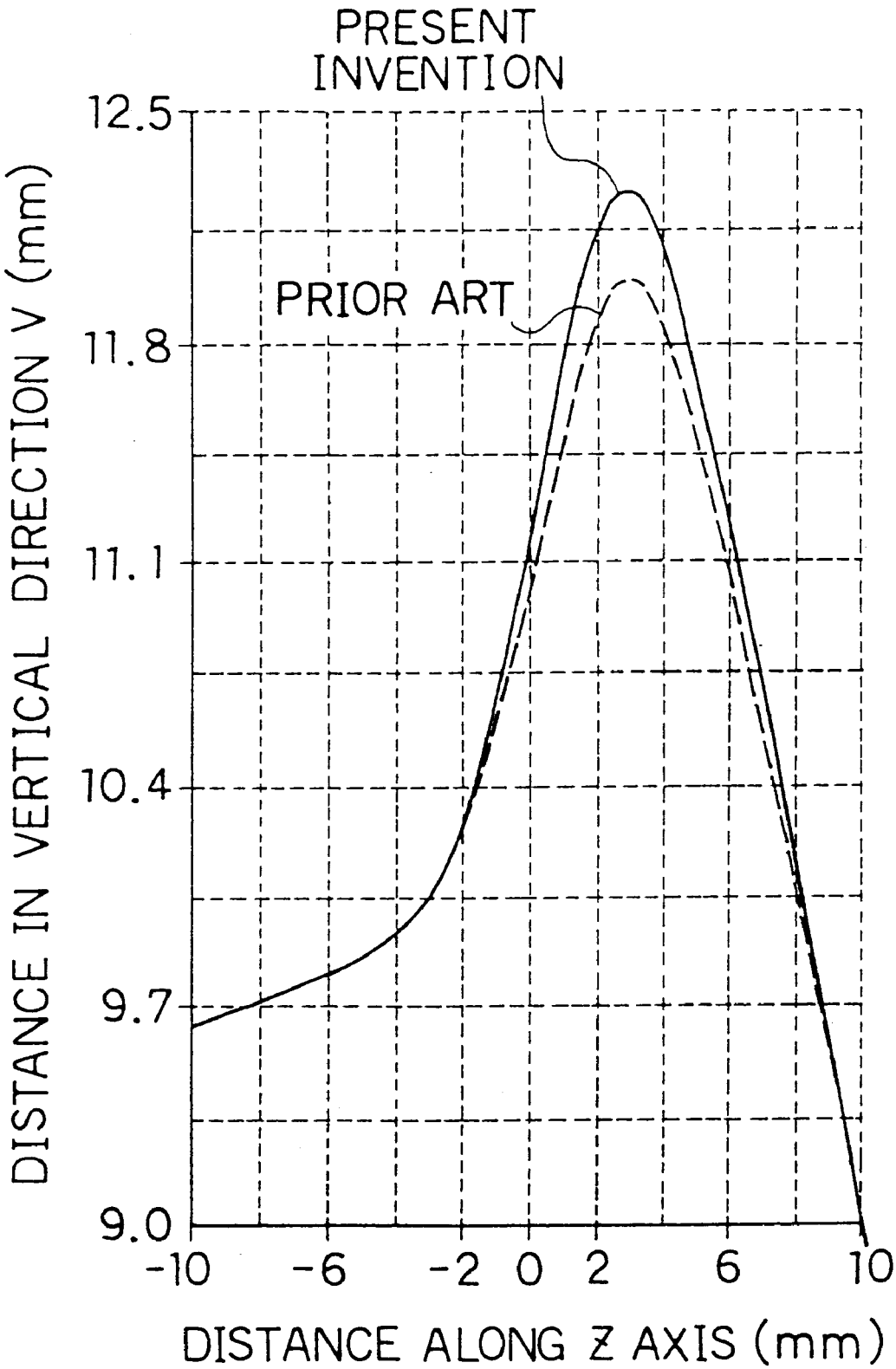
FIG. 5 is a graph showing the relation between the position on Z axis and the vertical deflection of the electron beam track according to the invention and the prior art.

As a result, the orbit of the electron beam according to the invention, as compared with that of the prior art, undergoes a change as shown in FIG. 4 in horizontal direction and as shown in FIG. 5 in vertical direction. The ordinates in FIG. 4 and FIG. 5 represent a distance from Z axis and the abscissas represent a distance along the Z axis. In the prior art, the difference in orbit is so large between horizontal and vertical directions that the horizontal orbit is situated farther from Z axis than the vertical orbit. This indicates a smaller horizontal lens diameter and a larger vertical lens diameter.

According to the present invention, in contrast, the difference of the electron beam trajectories between horizontal and vertical directions is so small that the horizontal orbit is situated nearer to Z axis than in the prior art. This indicates that the spherical aberration of the main lenses in horizontal direction is reduced and the lens diameter can be increased in horizontal direction. When the distance between the center C1 of the center lens and the center C2 or C3 of the side lenses shown in FIG. 1 is substantially constant, the result of simulation shows that the horizontal lens diameter, which has been at most 5.7 mm in the prior art, can be increased up to 6.3 mm, or by about 10%, according to the present embodiment.

The sectional shape of the spot on the peripheral portion of the screen of the in-line color picture tube is generally distorted into an ellipse having a laterally long diameter due to the deflection distortion. This trend becomes more conspicuous as a result of the flattening of a phosphor screen and the increase in deflection angle. For making as complete a round as possible of the sectional shape of the peripheral spot and reducing the diameter of the horizontal spot, the beam is required to be expanded along horizontal direction.

In the horizontal lens of the prior art, however, the beam, if excessively expanded, would be affected by the spherical aberration due to the small horizontal lens diameter. Therefore, the spot diameter could not be reduced.

According to the present embodiment, in contrast, the horizontal diameter can be increased as compared with the prior art by attaining the ratio $\phi v/Ls$ of 0.48 between the vertical diameter $\phi v$ and the horizontal diameter Ls. The resulting smaller spherical aberration can reduce the horizontal diameter of the peripheral spot.

Figure 6:
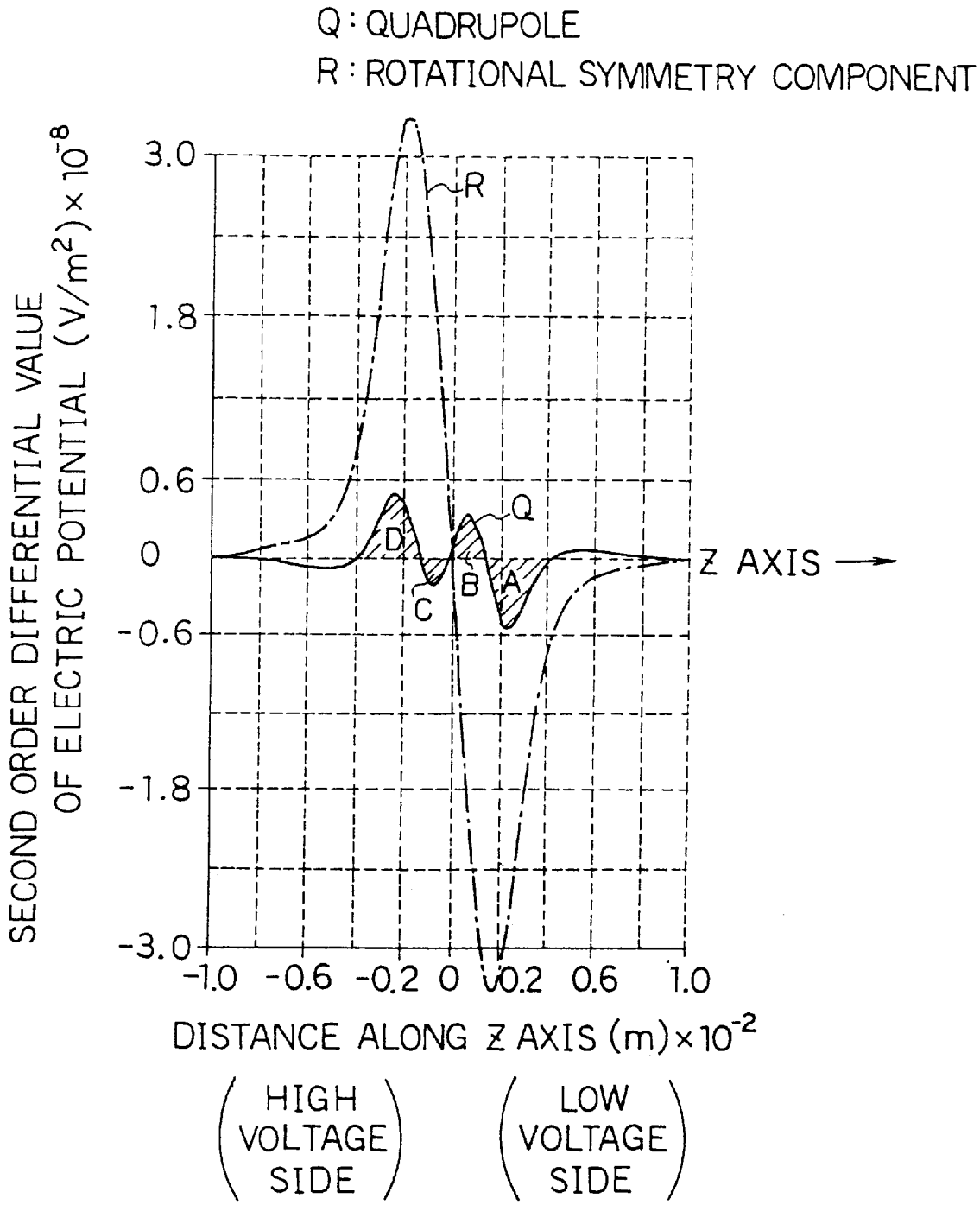
FIG. 6 is a graph showing the change along Z axis of the quadrupole component Q and the rotational symmetry component R formed by the focusing grid according another embodiment of to the invention.

The quadrupole field shown in FIG. 3 constituting the feature of the present invention can be attained also by setting the ratio $\phi v/Ls$ to 0.48 or less. In such a case, the ratios L3/Ls and L4/Ls of the distances L3 and L4 of the field correcting grids 3 and 7 from the openings 1*a* and 2*a*, respectively, to the horizontal diameter Ls of the openings are required to be 0.15 or more. FIG. 6 shows a representative example of the field distribution of Q and R in which the horizontal diameter Ls is 14.0 mm, the vertical diameter $\phi v$ is 6.7 mm with the ratio $\phi v/Ls$ fixed to about 0.48, and the ratios L3/Ls and L4/Ls are both smaller than 0.15. Even if $\phi v/Ls$ is about 0.48 or less, as far as the ratios L3/Ls and L4/Ls are smaller than 0.15, as shown in FIG. 6, the Q curve is seen to define the area B above Z axis smaller than the area A below Z axis on low voltage side. The Q curve is also seen to define the area C below Z axis smaller than the area D above Z axis on high voltage side. Therefore, it is impossible to produce the intended quadrupole field as shown in FIG. 3.

On the contrary, an excessively large ratio L3/Ls or L4/Ls causes another problem described below. Specifically, the focus voltage difference between a horizontal focusing voltage and a vertical focusing voltage would rise excessively, and the distance S between the center C1 of the center lens and the center C2 or C3 of the side lenses would decrease excessively. It is therefore preferable not to increase the ratios L3/Ls and L4/Ls to more than 0.25.

Figure 8:
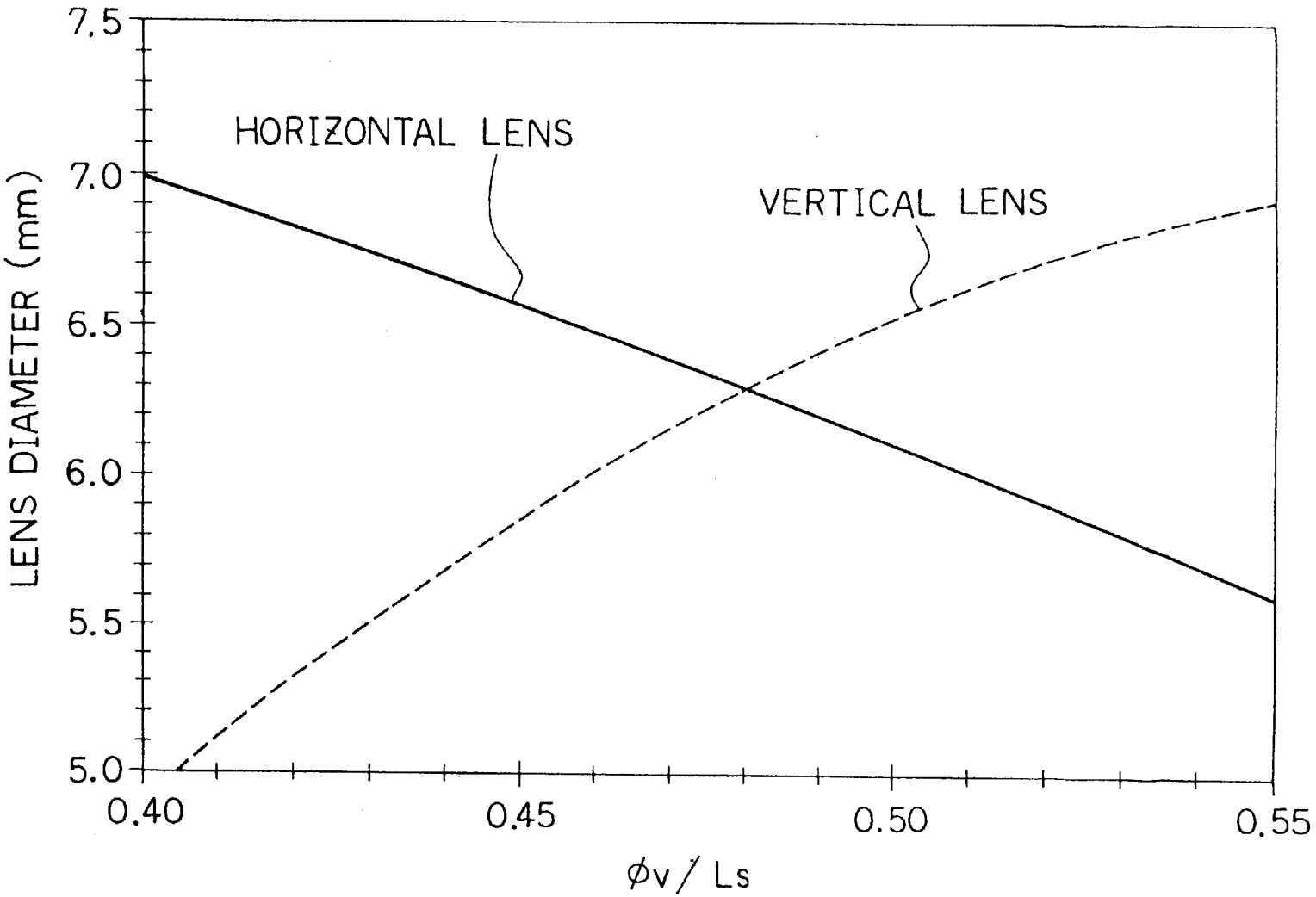
FIG. 8 is a graph showing the relation between the diameters of the horizontal and vertical lenses and the ratio $\phi v/Ls$ of the vertical diameter $\phi v$ to the horizontal diameter Ls.
Figure 9A:
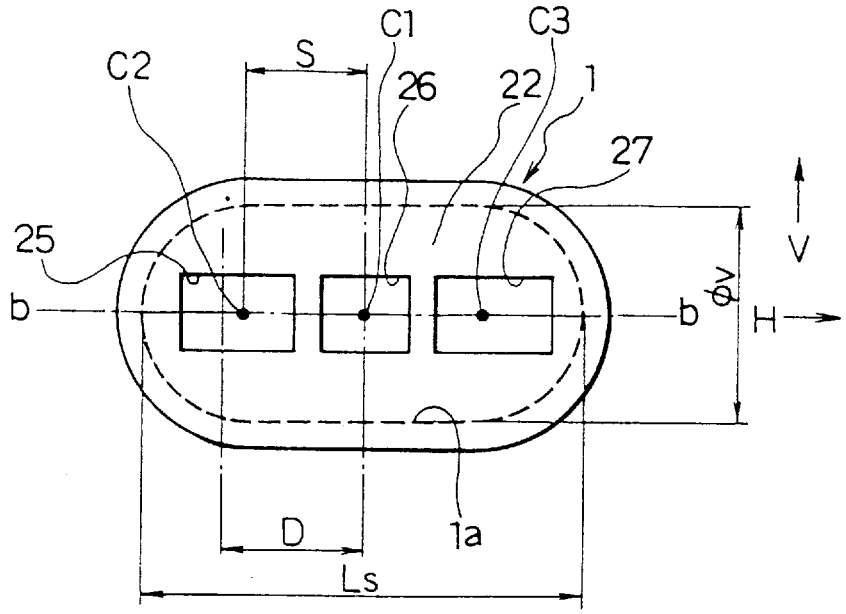
FIG. 9A is a front view of the final accelerating grid 2A having the grid 22 for generating the quadrupole lens action according to another embodiment of the invention.
Figure 9B:
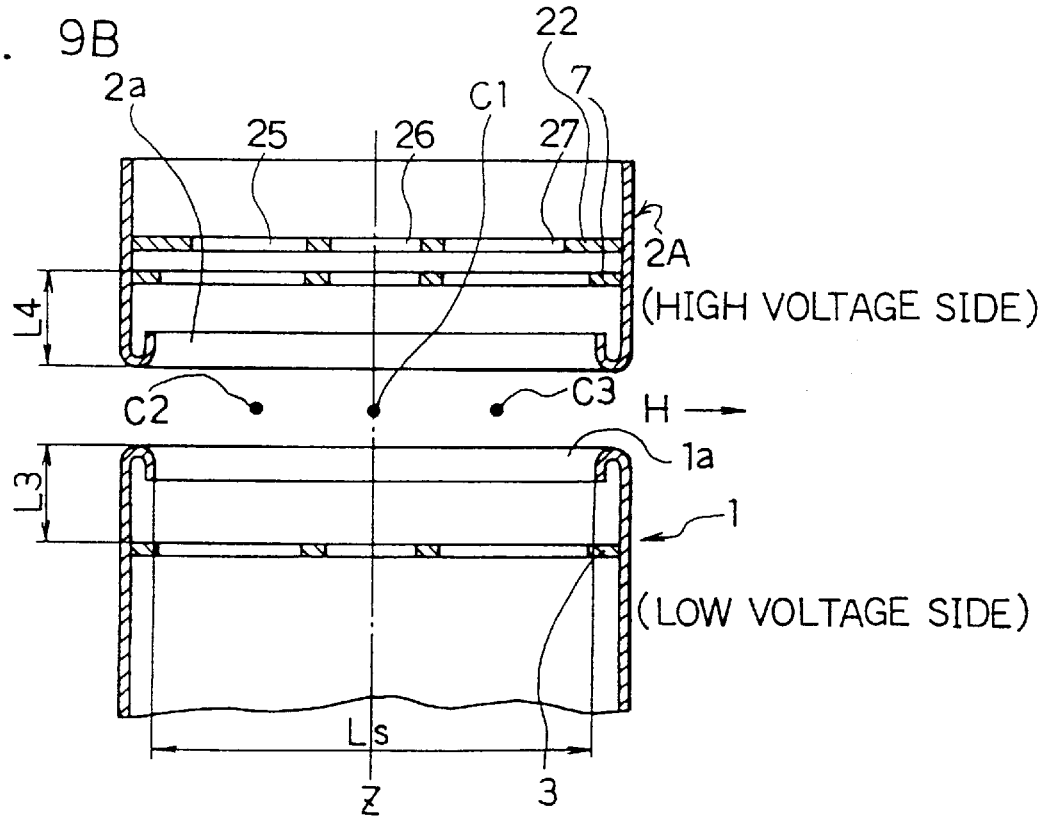
FIG. 9B is a sectional view taken in line b—b in FIG. 9A.
Figure 10:
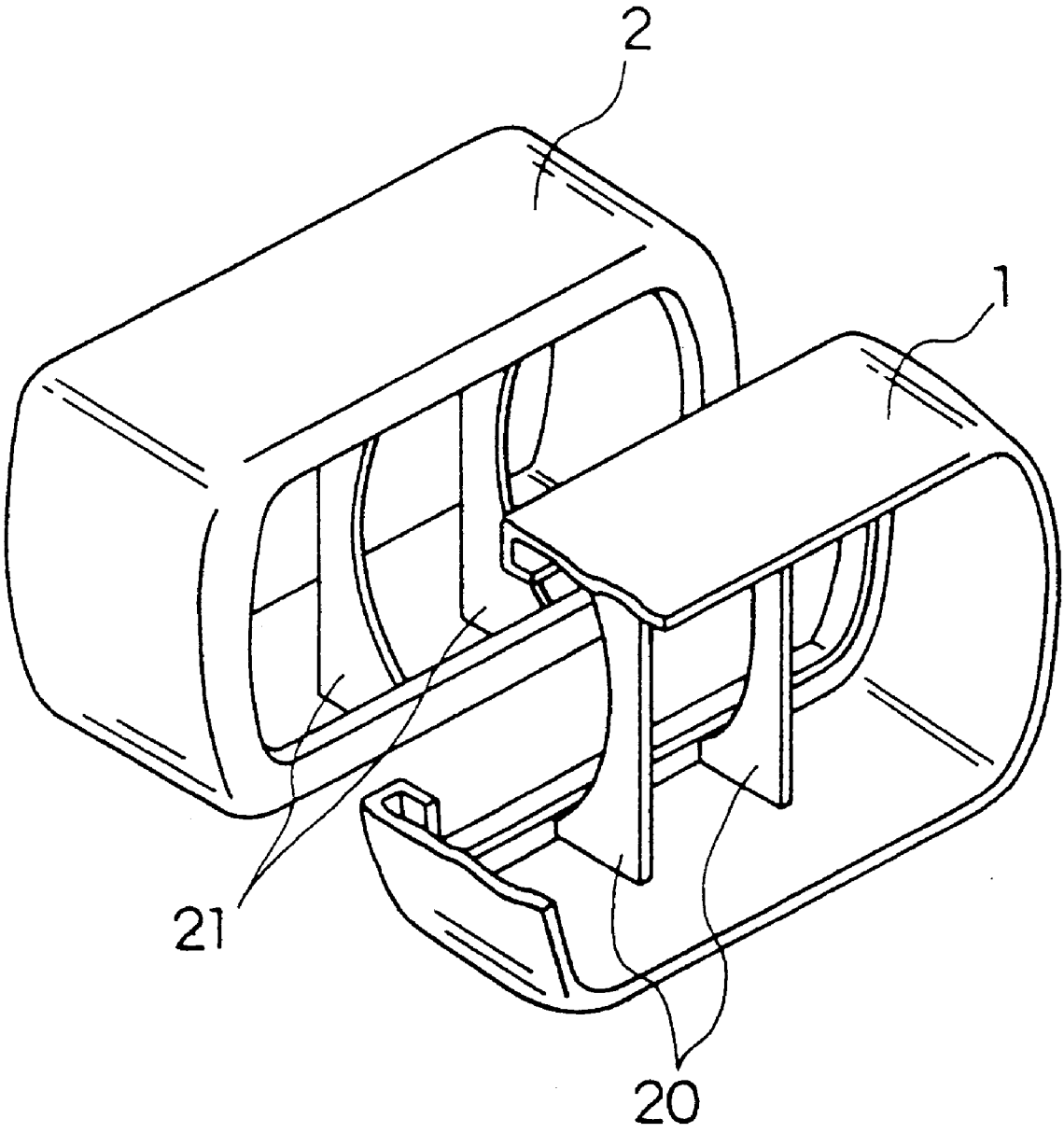
FIG. 10 is a perspective view of a focusing grid having a screen-like grid according to still another embodiment of the invention.

An excessively small ratio $\phi v/Ls$ causes still another problem described below. For example, the vertical lens diameter would become too small. FIG. 8 shows the relation between the ratio $\phi v/Ls$ and the horizontal and vertical lens diameters. As shown in FIG. 8, the problem of an excessively small vertical lens diameter for an increased vertical spot diameter is caused by the ratio $\phi v/Ls$ of 0.40 or less. The ratio $\phi v/Ls$, therefore, is preferably 0.40 or more.

Now, another embodiment of the invention will be explained. In this embodiment, configurations of the focusing grid 1 and the final accelerating grid 2 are similar to those of FIG. 2, but the ratio $\phi v/Ls$ and dimensions are different from those of the previous embodiment. According to this embodiment, even in the case where the ratio $\phi v/Ls$ is larger than 0.48, a similar effect to the aforementioned embodiment is obtained by elongating the apertures of the field correcting grids 3 and 7 laterally as compared with the prior art.

For example, the horizontal diameters Ls of the openings 1*a*, 2*a* of the focusing grid 1 and the final accelerating grid 2 are set to 14.0 mm, and the vertical diameters $\phi v$ of the openings 1*a*, 2*a* are set to 7.5 mm, with the ratio $\phi v/Ls$ set to about 0.54. The horizontal and vertical radii of the apertures 5 and 9 are set to 1.71 mm and 2.27 mm, respectively, with the ratio of the horizontal radius to the vertical radius set to 0.75. The horizontal and vertical radii of the apertures 4, 6, 8 and 10 are set to 2.47 mm and 2.27 mm, respectively. Furthermore, as shown in the area E of FIG. 7, a grid 22 is provided on the final accelerating grid 2A to generate such a quadrupole lens action as to make negative the Q curve on high voltage side. The grid 22 has three rectangular apertures 25, 26, 27 allowing the electron beam to pass therethrough.

The configuration of the focusing grid and the final accelerating grid for generating the quadrupole component Q and the rotational symmetry component R shown in FIG. 11 of the prior art is substantially the same as that shown in FIG. 2. Such configuration of the prior art represents a color picture tube with the neck diameter of $\phi$32.5 mm and openings of 2.4 mm in horizontal radius and 3.2 mm in vertical radius. For comparison with the embodiment, let us apply the prior art to the color picture tube with the neck diameter of $\phi$24.3 mm. The result is that the horizontal radii of the apertures 5 and 9 are 1.71 mm and the vertical radii 2.47 mm. Also, both the horizontal and vertical radii of the apertures 4, 6, 8 and 10 are 2.47 mm.

Figure 7:
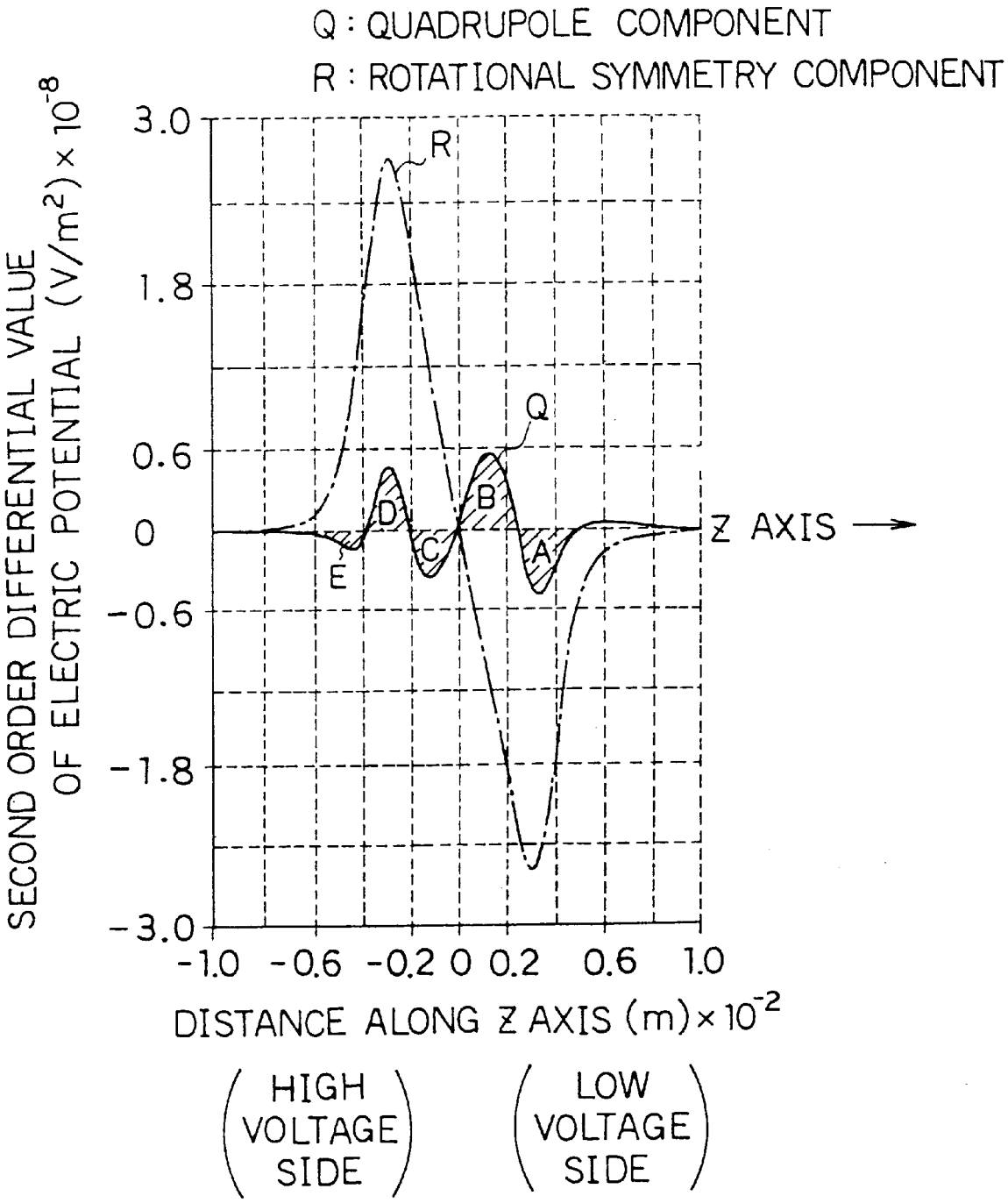
FIG. 7 is a graph showing the change along Z axis of the quadrupole component Q and the rotational symmetry component R formed by the focusing grid according still another embodiment of to the invention.

The R and Q curves in accordance with the embodiment are shown in FIG. 7. Comparison of FIG. 7 with the prior art in FIG. 11 shows that according to the embodiment of FIG. 7, the area B above Z axis is slightly larger than the area A below Z axis on low voltage side and the sum of the areas C and E below Z axis slightly larger than the area D above Z axis on high voltage side. As a result, according to the embodiment, the horizontal lens diameter, which is 5.7 mm according to the prior art, can be increased up to 6.1 mm. As described above, according to the embodiment, even in the case where the ratio $\phi v/Ls$ is larger than 0.4, the horizontal lens diameter can be increased by providing the grid 22 for generating the quadrupole lens action on high voltage side.

Further, the apertures 4, 6, 8, 10 of the field correcting grids 3 and 7, which are laterally elongated according to the embodiment, can alternatively be designed as longitudinally elongated apertures with equal effect. Also, the field correcting grids 3, 7 can be replaced with screen-like grids 20, 21 shown in FIG. 10.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. An in-line color picture tube, comprising:

focusing and accelerating grids each having a horizontal long axis and an elliptical opening at respective opposite faces;

primary and secondary field-correcting grids disposed in said focusing and accelerating grids, respectively, and a plurality of lens actions in a low-voltage section proximate to the focusing grid and a high-voltage section proximate to the accelerating grid, wherein:

each of the plurality of lens actions has a horizontal focusing force and a vertical focusing force, the horizontal focusing force of the lens action is weaker than the vertical focusing force of the lens action in the low voltage section of the lens action, and the horizontal diverging force of the lens action is weaker than the vertical diverging force of the lens action in the high-voltage section of the lens action.

2. An in-line color picture tube, comprising:

focusing and accelerating grids each having a horizontal long axis and an elliptical opening;

primary and secondary field-correcting grids disposed in said focusing and accelerating grids, respectively, and a plurality of lens actions in a low-voltage section proximate to the focusing grid and a high-voltage section proximate to the accelerating grid, wherein:

each of the plurality of lens actions has a horizontal focusing force and a vertical focusing force, the horizontal focusing force of the lens action is weaker than the vertical focusing force of the lens action in the low voltage section of the lens action, and the horizontal diverging force of the lens action is weaker than the vertical diverging force of the lens action in the high-voltage section of the lens action, wherein:

the elliptical openings have a vertical diameter $\phi v$ and a horizontal diameter Ls; and a first ratio $\phi v/Ls$ of the vertical diameter $\phi v$ to the horizontal diameter Ls of the elliptical openings is not more than 0.48.

3. An in-line color picture tube, comprising:

primary and secondary field correcting grids;

focusing and accelerating grids each having a horizontal long axis and an elliptical opening;

a center between the focusing and accelerating grids, wherein:

the focusing grid includes the primary field correcting grid, the accelerating grid includes the secondary field correcting grid, the primary field correcting grid includes three primary in-line apertures, the secondary field correcting grid includes three secondary in-line apertures, each of the three primary in-line apertures operatively engages a corresponding one of the three secondary in-line apertures to form a lens action between each of the corresponding primary and secondary in-line apertures, the lens action has a horizontal focusing force and a vertical focusing force, the elliptical opening has a vertical diameter and a horizontal diameter, and the vertical diameter and the horizontal diameter of the elliptical opening are selected so that:

the horizontal focusing force of the lens action is weaker than the vertical focusing force of the lens action between the first field correcting grid and the center, and the horizontal diverging force of the lens action is weaker than the vertical diverging force of the lens action between the center and the second field correcting grid, wherein:

the elliptical openings have a vertical diameter $\phi v$ and a horizontal diameter Ls; and a first ratio $\phi v/Ls$ of the vertical diameter $\phi v$ to the horizontal diameter Ls of the elliptical openings is not more than 0.48.

4. An in-line color picture tube, comprising:

focusing and accelerating grids each having a horizontal long axis and an elliptical opening;

primary and secondary field-correcting grids disposed in said focusing and accelerating grids, respectively, and a plurality of lens actions in a low-voltage section proximate to the focusing grid and a high-voltage section proximate to the accelerating grid, wherein:

each of the plurality of lens actions has a horizontal focusing force and a vertical focusing force, the horizontal focusing force of the lens action is weaker than the vertical focusing force of the lens action in the low voltage section of the lens action, and the horizontal diverging force of the lens action is weaker than the vertical diverging force of the lens action in the high-voltage section of the lens action, wherein:

the focusing and accelerating grids respectively have a primary and secondary field-correcting grids;

the focusing and accelerating grid respectively have a primary and secondary open end which face each other;

the elliptical openings have a horizontal diameter Ls;

there is a first distance L3 between the primary open end and primary field-correcting grid;

there is a second distance L4 between the secondary open end and secondary field-correcting grid;

a first ratio L3/Ls of the first distance L3 to the horizontal diameter Ls is 0.15 or more; and a second ratio L4/Ls of the second distance L4 to the horizontal diameter Ls is 0.15 or more.

5. An in-line color picture tube, comprising:

primary and secondary field correcting grids;

focusing and accelerating grids each having a horizontal long axis and an elliptical opening at respective opposite faces;

a center between the focusing and accelerating grids, wherein:

the focusing grid includes the primary field correcting grid, the accelerating grid includes the secondary field correcting grid, the primary field correcting grid includes three primary in-line apertures, the secondary field correcting grid includes three secondary in-line apertures, each of the three primary in-line apertures operatively engages a corresponding one of the three secondary in-line apertures to form a lens action between each of the corresponding primary and secondary in-line apertures, the lens action has a horizontal focusing force and a vertical focusing force, the elliptical opening has a vertical diameter and a horizontal diameter, and the vertical diameter and the horizontal diameter of the elliptical opening are selected so that:

the horizontal focusing force of the lens action is weaker than the vertical focusing force of the lens action between the first field correcting grid and the center, and the horizontal diverging force of the lens action is weaker than the vertical diverging force of the lens action between the center and the second field correcting grid.

6. An in-line color picture tube, comprising:

primary and secondary field correcting grids;

focusing and accelerating grids each having a horizontal long axis and an elliptical opening;

a center between the focusing and accelerating grids, wherein:

the focusing grid includes the primary field correcting grid, the accelerating grid includes the secondary field correcting grid, the primary field correcting grid includes three primary in-line apertures, the secondary field correcting grid includes three secondary in-line apertures, each of the three primary in-line apertures operatively engages a corresponding one of the three secondary in-line apertures to form a lens action between each of the corresponding primary and secondary in-line apertures, the lens action has a horizontal focusing force and a vertical focusing force, the elliptical opening has a vertical diameter and a horizontal diameter, and the vertical diameter and the horizontal diameter of the elliptical opening are selected so that:

the horizontal focusing force of the lens action is weaker than the vertical focusing force of the lens action between the first field correcting grid and the center, and the horizontal diverging force of the lens action is weaker than the vertical diverging force of the lens action between the center and the second field correcting grid, wherein:

the focusing and accelerating grid respectively have a primary and secondary open end which face each other;

the elliptical openings have a horizontal diameter Ls;

there is a first distance L3 between the primary open end and primary field-correcting grid;

there is a second distance L4 between the secondary open end and secondary field-correcting grid;

a first ratio L3/Ls of the first distance L3 to the horizontal diameter Ls is 0.15 or more; and a second ratio L4/Ls of the second distance L4 to the horizontal diameter Ls is 0.15 or more.

7. The in-line color picture tube of claim 2, wherein:

the focusing and accelerating grid respectively have a primary and secondary open end which face each other;

there is a first distance L3 between the primary open end and primary field-correcting grid;

there is a second distance L4 between the secondary open end and secondary field-correcting grid;

a second ratio L3/Ls of the first distance L3 to the horizontal diameter Ls is 0.15 or more; and a third ratio L4/Ls of the second distance L4 to the horizontal diameter Ls is 0.15 or more.

8. The in-line color picture tube of claim 3, wherein:

the focusing and accelerating grid respectively have a primary and secondary open end which face each other;

there is a first distance L3 between the primary open end and primary field-correcting grid;

there is a second distance L4 between the second open end and secondary field-correcting grid;

a second ratio L3/Ls of the first distance L3 to the horizontal diameter Ls is 0.15 or more; and a third ratio L4/Ls of the second distance L4 to the horizontal diameter is 0.15 or more.

* * * * *